US006215103B1

(12) United States Patent
Arai et al.

(10) Patent No.: US 6,215,103 B1
(45) Date of Patent: Apr. 10, 2001

(54) HEAT DEVELOPING APPARATUS

(75) Inventors: Eichi Arai; Shinichi Matsuda; Hiroshi Nakahashi; Akihiro Hashiguchi, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/320,455

(22) Filed: May 27, 1999

(30) Foreign Application Priority Data

May 28, 1998 (JP) ..... 10-146918
May 6, 1999 (JP) ..... 11-125882

(51) Int. Cl.[7] ..... H05B 1/00

(52) U.S. Cl. ..... 219/216; 219/388; 399/335; 118/60

(58) Field of Search ..... 219/388, 216, 219/469–471; 469/471; 399/335, 336, 337; 432/60, 228; 492/46; 118/60

(56) References Cited

U.S. PATENT DOCUMENTS 3,449,547 * 6/1969 Goodman et al. ..... 219/216
3,517,164 * 6/1970 Huggins et al. ..... 219/388
3,980,863 * 9/1976 Wulz et al. ..... 219/388
4,317,026 * 2/1982 Koblo et al. ..... 219/216
4,665,303 * 5/1987 Miyakawa et al. ..... 219/216

* cited by examiner

*Primary Examiner*—Teresa Walberg
*Assistant Examiner*—Shawntina T. Fuqua
(74) *Attorney, Agent, or Firm*—Sughrue, Mion, Zinn, Macpeak & Seas, PLLC

(57) ABSTRACT

In a heat developing section, heater boxes heated by sheet-like heaters are disposed vertically in pairs between an insertion roller pair and a discharging roller pair. When a heat developing photosensitive material is fed between the heater boxes by the insertion roller pair with a photosensitive layer of the heat developing photosensitive layer facing upward, it is guided by a guide plate of a lower heater box and is conveyed with an air layer being constantly formed between an upper heater box and the heat developing photosensitive material. As a result, the heat developing photosensitive material is heated without the photosensitive layer thereof being pressed. Accordingly, the heat developing photosensitive material is uniformly heated with no wrinkles generated therein, and an image of high finished quality is formed.

22 Claims, 8 Drawing Sheets

HEAT DEVELOPING APPARATUS

BACKGROUND OF THE INVENTION

1. Field of the Invention

The present invention relates to a heat developing apparatus in which a latent image of a heat developing photosensitive material is made visible by being heated thereby developing processing the heat developing photosensitive material.

2. Description of the Related Art

In addition to the photosensitive material that makes visible a latent image formed on the photosensitive material by a wet developing process using a processing solution such as developer, fixer or the like, a photosensitive material that makes visible a latent image by a dry developing process that does not use a processing solution has been used.

As one example of the dry developing process, the following heat- developing is generally carried out: the photosensitive material on which the image is formed by exposure and the image receiving material are superimposed, heated and pressed, thereby transferring the image according to the latent image formed on the photosensitive material by exposure to the image receiving material.

On the other hand, the photosensitive material that is developed by the dry developing process forms a photosensitive layer by using an emulsion that scatters silver halide acting as a photocatalyst, a silver salt acting as an image forming material, a reducing agent for silver ions, and the like within the binder. By heating such a photosensitive material to a predetermined temperature, the latent image formed on the photosensitive layer by exposure can be made visible (hereinafter, referred to a heat developing photosensitive material).

Generally, the heat developing apparatus, which carries out the heat-developing, is provided with a multiplicity of rollers disposed at a heating drum and at a peripheral portion thereof. In such a heat developing apparatus, the heat developing photosensitive material is entrained about the heating drum, while being pressed by the rollers. Then, the heating drum is rotated while the heat developing photosensitive material is nipped between the heating drum and the rollers, thereby transporting the heat developing photosensitive material while heating the heat developing material by the heat of the heating drum.

Examples of the heat developing apparatuses that simultaneously transport and heat the heat developing photosensitive material include a heat developing apparatus in which the heat developing photosensitive material is nipped and transported by multiple roller pairs and heated by heating means such as a heater or the like when the heat developing photosensitive material is passed between the rollers.

However, in some heat developing photosensitive materials, a photosensitive layer may swell and then harden due to heating. With such heat developing photosensitive materials, during heating, wrinkles may be generated because of the photosensitive layer being pressed by the rollers, and irregularities in density due to uneven heating may also be generated.

Especially, in the heat developing apparatus in which the heat developing photosensitive material is nipped and transported by the multiple roller pairs, the surface temperature of the heat developing photosensitive material in the state of being nipped by the rollers and the surface temperature thereof in the state of passing between the roller pairs are different from each other. Further, unless the heat developing photosensitive material is in a state of uniformly contacting a guide or the like, a difference in the surface temperature of the heat developing photosensitive material is caused between a portion which contacts the guide, and other portion which doses not contact the guide.

The deviation in the temperature causes irregularities in density of an image recorded on the heat developing photosensitive material, and when the heat developing photosensitive material is nipped by the rollers, wrinkles are generated in the heat developing photosensitive material due to elongation thereof caused by linear expansion. As a result, the finished quality of the image is deteriorated.

SUMMARY OF THE INVENTION

In view of the aforementioned, an object of the present invention is to solve the above-described drawbacks and to provide a heat developing apparatus in which a heat developing photosensitive material is developed uniformly, generation of wrinkles or irregularities in density can be prevented, and an image of high finished quality can be formed.

In accordance with a first aspect of the present invention, there is provided a heat developing apparatus in which a heat developing photosensitive material is heated while being transported, comprising: insertion means which is disposed at an upstream side of a heating section for heating the heat developing photosensitive material and which nips and conveys the heat developing photosensitive material to the heating section; discharging means which is disposed at a downstream side of the heating section and discharges the heat developing photosensitive material from the heating section; heating means for heating the heat developing photosensitive material in a state of being conveyed in the heating section; and guide means for guiding the heat developing photosensitive material, which is conveyed between the insertion means and the discharging means, while constantly forming an air layer on a surface of the heat developing photosensitive material, which surface has an image recorded thereon.

According to the first aspect of the present invention, when the heat developing photosensitive material is conveyed between the insertion means and the discharging means, the guide means guides the heat developing photosensitive material in a state of forming an air layer between the guide means and the surface of the heat developing photosensitive material with an image region provided thereon. The air in the air layer is heated by the heating means and the heat developing photosensitive material is heated by heat received from the guide means and by heat of the air in the air layer.

Due to the air layer being formed, the heat developing photosensitive material is conveyed in such a manner that a photosensitive layer thereof does not contact conveying means such as rollers. For this reason, generation of wrinkles caused by application of pressure onto the photosensitive layer during the heating is prevented.

In accordance with a second aspect of the present invention, in the heat developing apparatus according to the first aspect of the present invention, the guide means includes a guide plate which faces a transporting passage of the heat developing photosensitive material and a heat insulating member is provided in at least one portion of a surface of the guide plate, which surface contacts the heat developing photosensitive material.

According to the second aspect of the present invention, the heat developing photosensitive material inserted by the insertion means is conveyed on the guide plate with the heat insulating member provided thereon. The heat insulating member has a low thermal conductivity, and when the heat insulating member contacts the heat developing photosensitive material, changes in the temperature of the heat developing photosensitive material are slow.

Accordingly, when the heat developing photosensitive material contacts the guide plate, extreme changes in the temperature of portions of the heat developing photosensitive material can be prevented, and generation of wrinkles in the heat developing photosensitive material caused by extreme temperature changes can be prevented.

As the heat insulating member, various resin materials, such as aramid fiber, fluorocarbon resin, polyphenylene sulfide (PPS), polyimide (PI), polyamide-imide (PAI), polyacetal (POM), polyethersulphone (PES), polyamide (PA), polycarbonate (PC), acrylonitrile-butadiene-styrene (ABS), polyethylene (PE), and polyethylene terephthalate (PET), and glass fibers can be used singly or in combination. Further, as the heat insulating member, ceramic materials containing the above-mentioned resin materials or glass fibers can also be used.

It suffices that the thermal conductivity of the heat insulating member is at least lower than that of a member for forming the guide plate, which contacts the heat developing photosensitive material, and is preferably 1 Kcal/mh° C. or less.

The surface of the guide plate may be covered by the heat insulating member, or may be covered by a non-woven fabric cloth made of the heat insulating member. Further, it suffices that at least an upstream side of the guide plate in a direction in which the heat developing photosensitive material is conveyed is covered by the above-mentioned heat insulating member.

Further, the above-described second aspect of the present invention has a simple structure in which the guide plate and the heating means are merely disposed between the insertion means and the discharging means, and therefore, even if trouble in conveying the heat developing photosensitive material, such as jamming, occurs in a conveying mechanism, removal of the heat developing photosensitive material is facilitated.

In accordance with a third aspect of the present invention, in the heat developing apparatus according to the first aspect or the second aspect of the present invention, the discharging means discharges the heat developing photosensitive material in such a manner as to contact a non-image region of the heat developing photosensitive material.

According to the third aspect of the present invention, the discharging means contacts only the non-image region of the heat developing photosensitive material and does not contact an image region. For this reason, formation of wrinkles in the image region, caused by the rollers or the like contacting the photosensitive layer of the heat developing photosensitive material not only during heating, but also directly after the heating, can reliably be prevented.

In accordance with a fourth aspect of the present invention, in the heat developing apparatus according to any one of the first to third aspects of the present invention, the heat developing photosensitive material is transported on a guide plate, which forms the guide means, with a photosensitive layer of the heat developing photosensitive material facing upward.

According to the fourth aspect, the heat developing photosensitive material is transported with the photosensitive layer thereof facing upward.

Only the surface of the heat developing photosensitive material, which surface opposite to the photosensitive layer, contacts the guide plate and nothing contacts the photosensitive layer of the heat developing photosensitive material. Therefore, it is possible reliably to prevent occurrence of abrasion or the like at the photosensitive layer of the heat developing photosensitive material during the heatdevelopment.

It is preferable that surface treatment is applied to the guide plate employed in the fourth aspect of the present invention such that the surface contacting the heat developing photosensitive material smoothly guides the heat developing photosensitive material without causing damage thereto. Preferably, at the upstream side in the direction the heat developing photosensitive material is transported, the heat developing photosensitive material is heated uniformly and moderately using a non-fabric cloth or the like. For this reason, generation of irregularities in density due to uneven heating temperatures especially at the last stage of developing can be prevented, and an image of high quality formed by the heat developing photosensitive material without developer streaks can be attained.

DESCRIPTION OF THE PREFERRED EMBODIMENTS

Embodiments of the present invention will be described hereinafter with reference to the drawings.

Figure 1:
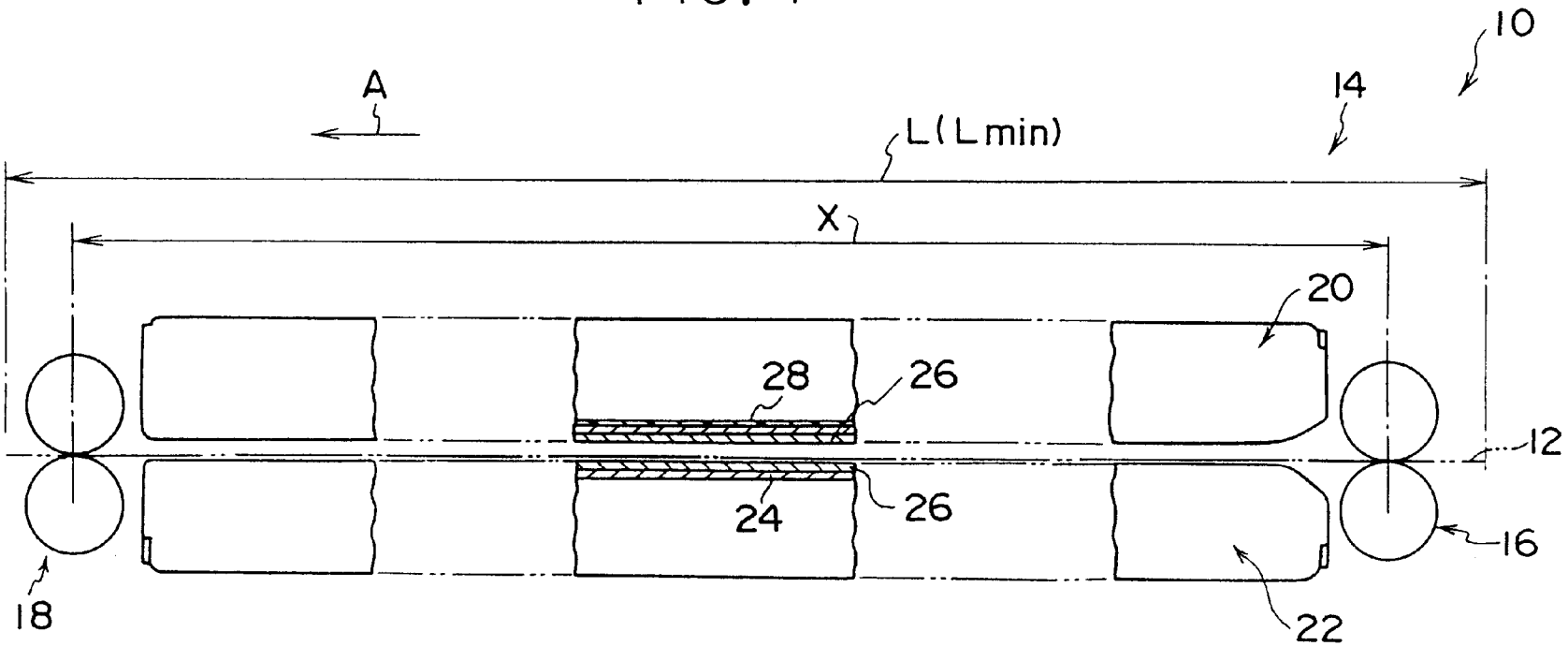
FIG. 1 is a schematic structural view illustrating a heat developing section of a heat developing apparatus, which is applied to a first embodiment of the present invention.
Figure 2:
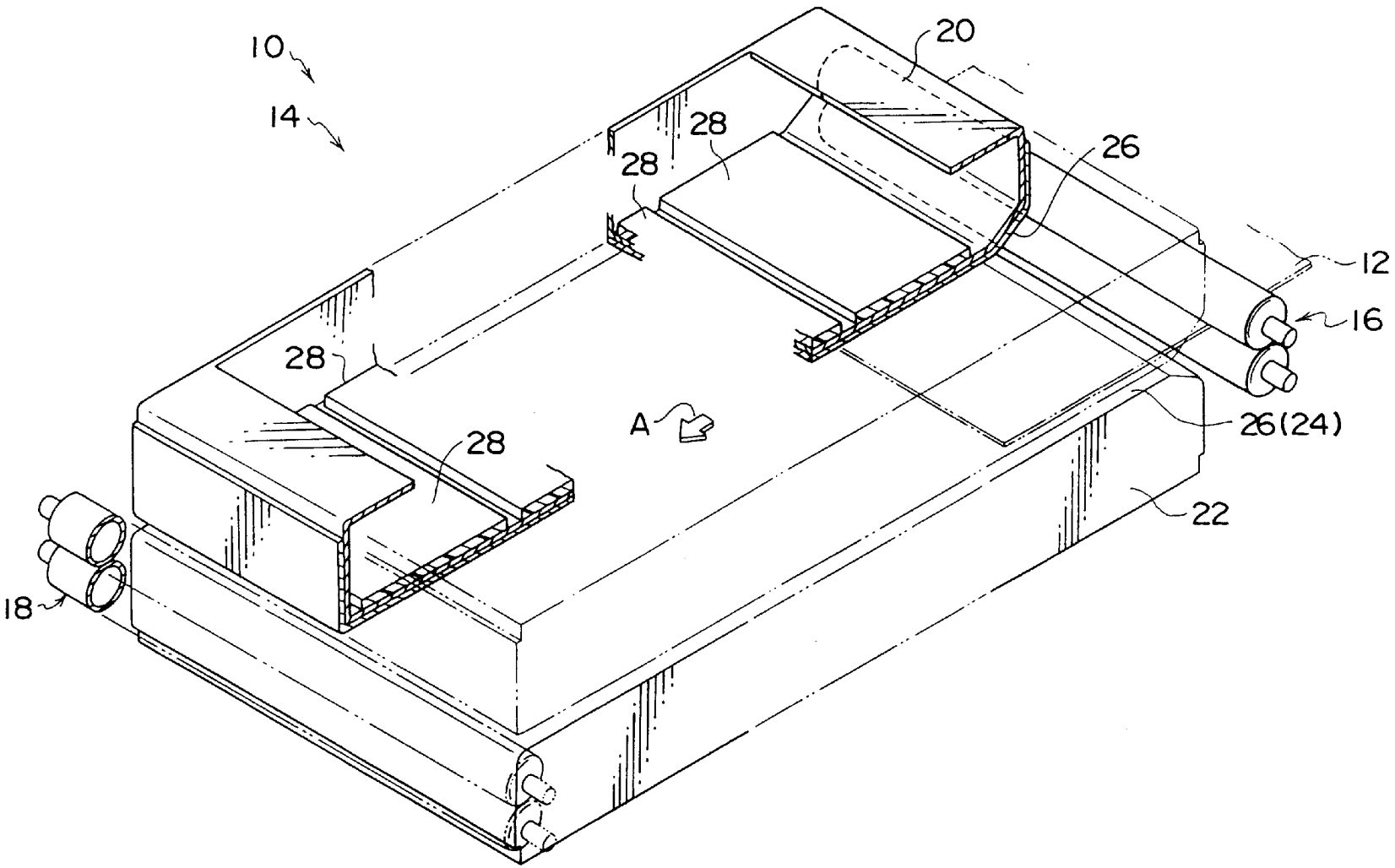
FIG. 2 is a schematic perspective view illustrating the heat developing section applied to the first embodiment of the present invention.

FIGS. 1 and 2 each show a schematic structure of a heat developing apparatus 10 which is applied to a first embodiment of the present invention. The heat developing apparatus 10 is structured such that a latent image on a photosensitive layer of a heat developing photosensitive material is made visible by heating and exposing a heat developing photosensitive material 12. Here, the heat developing apparatus 10 may be structured in such a manner that it is accommodated within an unillustrated casing, which is a single unit and processes continuously the heat developing photosensitive material 12 fed from an output apparatus, which exposes the photosensitive layer and forms the latent image. Further, the heat developing apparatus 10 may be integral with the output apparatus and accommodated within the same casing.

The heat developing photosensitive material 12, which is heated and developed by the heat developing apparatus 10, includes the photosensitive layer which is formed at one surface of a thin (for example, a thickness of about 0.12 mm) support such as polyethylene terephthalate (PET).

For example, the photosensitive layer of the heat developing photosensitive material 12 is formed by an emulsion in which silver halide acting as a photocatalyst, a silver salt acting as an image forming material, and a reducing agent for silver ions and the like are scattered within a binder. Due to exposure, the latent image is made visible simply by being heated at a predetermined temperature for a predetermined time, without having to be pressed. The photosensitive layer of the heat developing photosensitive material 12 is swelled. Wrinkles are generated because the photosensitive layer, which has been swelled especially during the heat-developing, is pressed, resulting extension thereof. As a result, the finished quality of the image deteriorates.

The heat developing photosensitive material 12 may be one for a monochromatic image or one for a color image.

As illustrated in FIGS. 1 and 2, in a heat developing section 14 of the heat developing apparatus 10, an insertion roller pair 16 is provided at the upstream side in the transporting direction of the heat developing photosensitive material 12 (i.e., the direction of an arrow A). A discharging roller pair 18 is provided at the downstream side in the transporting direction of the heat developing photosensitive material. The insertion roller pair 16 and the discharging roller pair 18 are each rotated and driven at a constant speed by driving force caused by unillustrated driving means. An unillustrated insertion sensor is provided at the upstream side of the insertion roller pair 16.

When the heat developing photosensitive material 12, which has been exposed imagewise by an unillustrated output apparatus, is fed towards the insertion roller pair 16 of the heat developing apparatus and is detected by the insertion sensor, the insertion roller pair 16 and the discharging roller pair 18 begin to be rotated and driven at a constant speed. The heat developing photosensitive material 12 is fed with the photosensitive layer side thereof being faced upward (upward in FIGS. 1 and 2).

When the insertion roller pair 16 is rotated and driven, the heat developing photosensitive material 12 is nipped by the insertion roller pair and fed into the heat developing section 14. The discharging roller pair 18 nips the heat developing photosensitive material 12 fed from the heat developing section 14 and discharges it from the heat developing section 14.

Rollers of the insertion roller pair 16 and the discharging roller pair 18 are formed by coating, for example, peripheral portions of metal rollers with a resin having a low heat conductivity. That is to say, the rollers that form the insertion roller pair 16 and the discharging roller pair 18 are formed such that the peripheral portions thereof that contact the heat developing photosensitive material 12 are formed by the resin having low heat conductivity. For this reason, the insertion roller pair 16 and the discharging roller pair 18 can prevent the contacted heat developing photosensitive material 12 from being heated or cooled unnecessarily.

The speed the heat developing photosensitive material 12 is conveyed by the discharging roller pair 18 is substantially the same as or is a little higher than the conveying speed of the insertion roller pair 16. As a result, formation of slack in the heat developing photosensitive material 12 between the insertion roller pair 16 and the discharging roller pair 18 is prevented.

Heater boxes 20 and 22, which are paired vertically, are disposed between the insertion roller pair 16 and the discharging roller pair 18 as heating means. The heater boxes 20, 22 are respectively formed from aluminum or the like in a substantially rectangular box shape with one surface thereof being open. The heater boxes 20, 22 are disposed in such a manner that their surfaces opposing their opened surfaces are faced with each other at a predetermined space. The heat developing photosensitive material 12 is fed between the heater boxes 20 and 22.

A transporting passage is formed between the heater boxes 20 and 22 which are paired vertically. The transporting passage side of the lower heater box 22 becomes a guide plate 24 (see FIG. 1). Therefore, the heat developing photosensitive material 12 fed between the heater boxes 20 and 22 is passed through between the heater boxes 20 and 22 while contacting the guide plate 24 of the heater box 22 with an air layer formed between the heater box 20 and the heat developing photosensitive material 12, and reaches the discharging roller pair 18.

As shown in FIG. 1, a transporting distance X of the heat developing photosensitive material 12 between the insertion roller pair 16 and the discharging roller pair 18 is a distance between respective axes of the insertion roller pair 16 and the discharging roller pair 18, and is shorter than a minimum length $L_{min}$ of a length L along the direction the heat developing photosensitive material 12 is transported ($X<L_{min}$). Namely, the transporting distance X is shorter than the length $L_{min}$ of the heat developing photosensitive material which means that the length L along the direction the heat developing photosensitive material 12 is transported to be developed by the heat developing apparatus 10 is minimum.

The heat developing photosensitive material 12 which has been fed between the heater box 20 and the heater box 22 by the insertion roller pair 16 is transported in such a manner that a leading end portion thereof is nipped by the discharging roller pair 18 before the trailing edge thereof leaves the insertion roller pair 16, and is passed between the heater box 20 and the heater box 22 at a constant speed without rollers or the like contacting the photosensitive layer.

As shown in FIGS. 1 and 2, a surface layer portion 26 is formed at the heater boxes 20, 22 at each of surfaces opposing the transporting passage of the heat developing photosensitive material 12. Each of the surface layer portions 26 are subjected to general surface treatment such as teflon coating, covering with a flocked material or a non-woven fabric cloth, or the like. Accordingly, the heat developing photosensitive material 12 is smoothly transported on the guide plate 24 of the heater box 22.

On the other hand, a sheet-like heater 28 is mounted within the heater boxes 20, 22. The sheet-like heater 28 is formed in a thin plate shape and mounted at surfaces of inner portions of the heater boxes 20,22, at sides of the transporting passage for the heat developing photosensitive material 12.

The heater boxes 20, 22 are heated by applying electricity to each of the sheet-like heaters 28 and maintained at a predetermined temperature by controlling application of electricity to the sheet-like heater 28. Accordingly, the air between the heater boxes 20, 22 is maintained at a predetermined temperature.

For this reason, when the heat developing photosensitive material 12 is passed between the heater boxes 20 and 22 while the respective surfaces thereof opposing to the photosensitive layer contact the surface layer portion 26 of the guide plate 24 of the heater box 22, the heat developing photosensitive material 12 is heated by heat from the surface layer portion 26 and heat of the air between the heater boxes 20 and 22.

Next, operation of the first embodiment of the present invention will be described.

In the heat developing apparatus 10, electricity is applied to each of the sheet-like heaters 28 within the heater boxes 20, 22 disposed between the insertion roller pair 16 and the discharging roller pair 18. When the heater boxes 20, 22 and air in the transporting passage between the heater boxes 20 and 22 reach a predetermined temperature, the heat developing photosensitive material 12 can be developed.

In the heat developing apparatus 10, when an unillustrated insertion sensor detects that the leading edge portion of the heat developing photosensitive material 12, which has been exposed imagewise by an unillustrated output apparatus, has been fed to the insertion roller pair 16, the insertion roller pair 16 and the discharging roller pair 18 begin to be rotated and driven.

The heat developing photosensitive material 12 is nipped by the insertion roller pair 16 and fed into the heat developing section 14, and transported between the heater boxes 20 and 22. The heat developing photosensitive material 12 which has been fed between the heater boxes 20 and 22 is moved between the heater boxes 20 and 22, while the respective surfaces thereof opposing to the photosensitive layer contacts the guide plate 24 of the heater box 22. Then the heat developing photosensitive material 12 is heated by heat from the heater box 22 and heat of the air between the heater boxes 20 and 22, so that the latent image formed on the photosensitive layer is made visible.

When the leading edge portion of the heat developing photosensitive material 12, which has been heat-developed as described above, reaches the discharging roller pair 18, the heat developing photosensitive material 12 is transported by the discharging roller pair 18 at a constant speed and is fed from the heat developing section 14.

In the heat developing photosensitive material 12, especially during the heat-developing, wrinkles, abrasion or the like are easily generated at the photosensitive layer. Moreover, irregularities in density of the image easily arise due to irregularities in temperature during heating.

With respect to this kind of heat developing photosensitive material 12, the heat developing apparatus 10 is structured such that the heat developing photosensitive material 12 is passed between the heater boxes 20 and 22 not so as to contact the rollers or the like. Further, the heat developing photosensitive material 12 is transported between the heater boxes 20 and 22 while a surface thereof, at a side opposite to the side at which the photosensitive layer is formed, contacts the guide plate 24 of the heater box 22, and an air layer is constantly formed between the heater box 20 and the surface of the heat developing photosensitive material 12 with the photosensitive layer formed thereon.

As a result, unnecessary pressure is not applied to the photosensitive layer of the heat developing photosensitive material 12 between the insertion roller pair 16 and the discharging roller pair 18 during the heat-developing. Therefore, wrinkles, abrasion or the like are not generated. Accordingly, the heat developing apparatus 10 can form an image of high finished quality without wrinkles, abrasion, or the like at the heat developing photosensitive material 12.

The heat developing apparatus 10 heats the heat developing photosensitive material 12 by heating the air between the heater boxes 20 and 22. Also, the heat developing photosensitive material 12 contacts the guide plate 24 of the heater box 22, and thus, the heat developing photosensitive material 12 is heated by the heater box 22. For this reason, because the heat developing apparatus 10 can heat the heat developing photosensitive material 12 uniformly and slowly, irregularities in density of the image due to irregularities in temperature during heating are not generated.

In the heat developing apparatus 10, a transporting mechanism for the heat developing photosensitive material 12 is simplified. The heat developing photosensitive material 12 is nipped only at the insertion side and the discharging side of the heat developing section 14. Accordingly, it is very easy to accomplish maintenance such as removing the heat developing photosensitive material 12 from the heat developing section 14 at the time of conveyance failures such as the heat developing photosensitive material 12 becoming jammed, or the like.

In the first embodiment of the present invention described above, although the discharging roller pair 18 is provided as transporting means and the heat developing photosensitive material 12 is pulled out from between the heater boxes 20 and 22 due to the discharging roller pair 18, the transporting means is not limited to the same.

Figure 3:
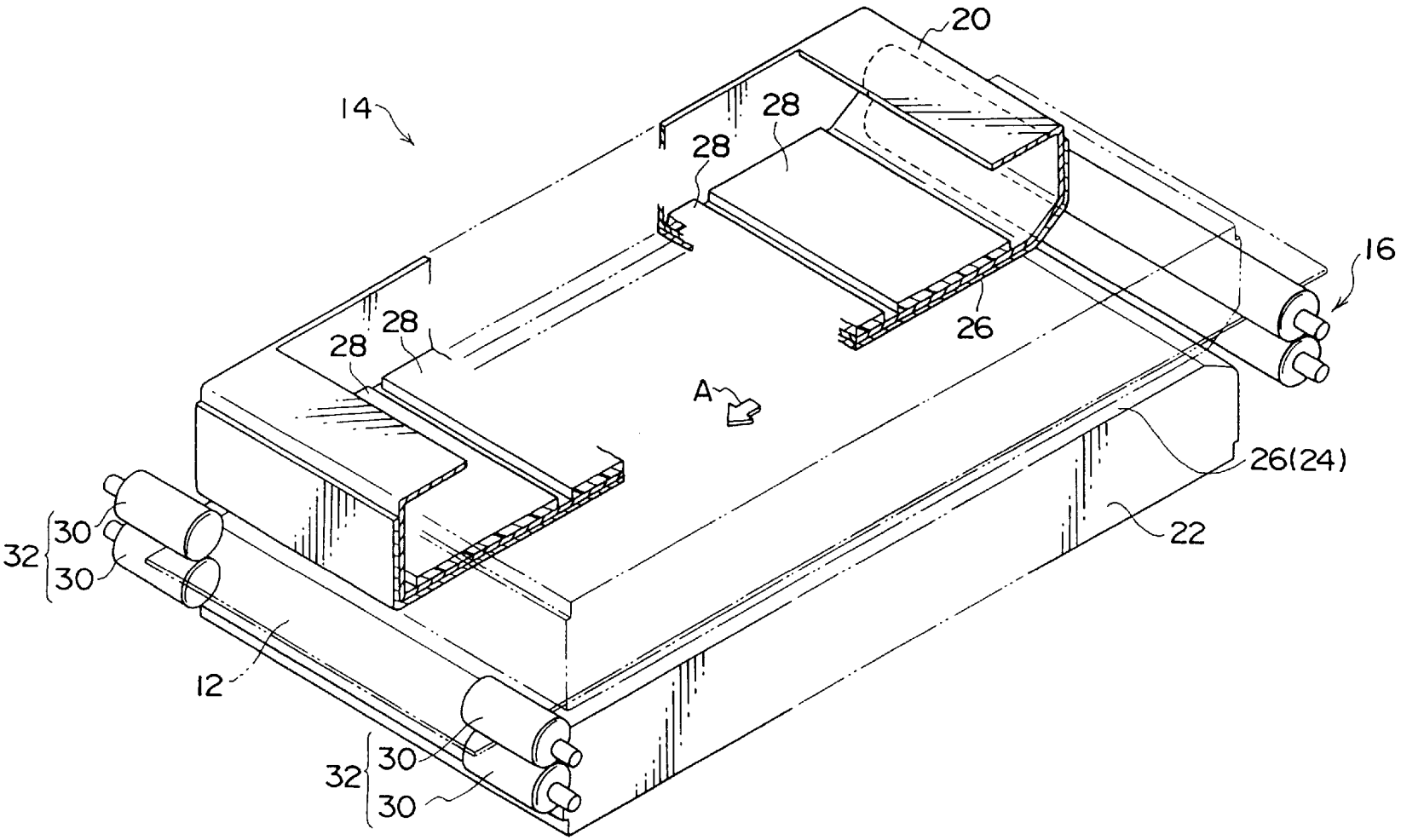
FIG. 3 is a schematic perspective view of the heat developing section illustrating one of discharging means which are different from that of the first embodiment of the present invention.

For example, as shown in FIG. 3, instead of the discharging roller pair 18, roller pairs 32, which consist of thin rollers 30 positioned vertically in pairs, may be provided at both sides in a direction perpendicular to the direction the heat developing photosensitive material 12 is transported (a transverse direction of the heat developing photosensitive material 12). The roller pairs 32 nip a non-image portion of the heat developing photosensitive material 12 provided at both end portions in the transverse direction thereof and feeds out the heat developing photosensitive material 12.

Figure 4:
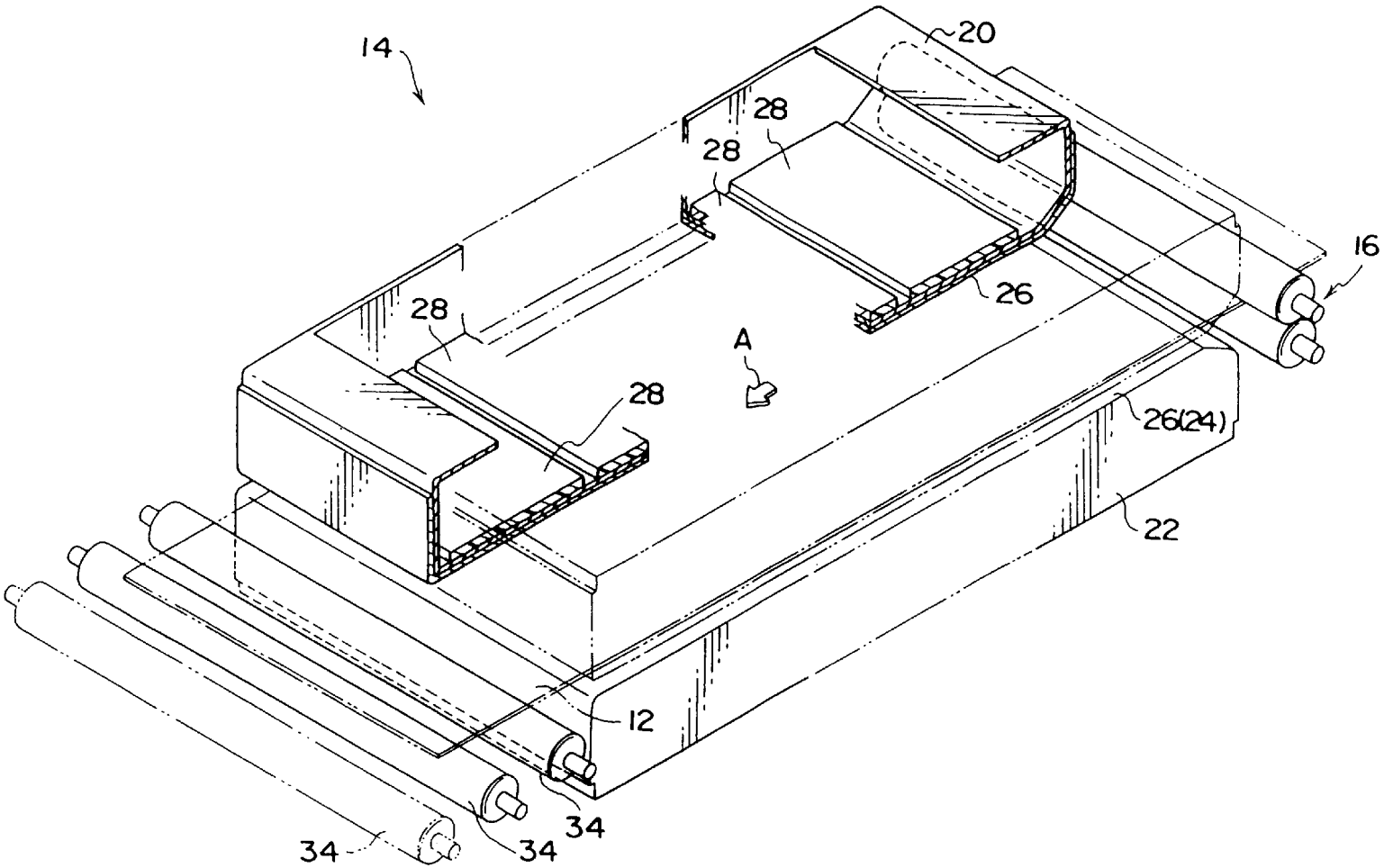
FIG. 4 is a schematic perspective view of the heat developing section illustrating one of discharging means which are different from that of FIG. 3.

As illustrated in FIG. 4, instead of the discharging roller pair 18, a plurality of rollers 34 may be provided. The rollers 34 are each formed such that the frictional force, generated when the peripheral portions thereof contact the surface opposite to the photosensitive layer of the heat developing photosensitive material 12, becomes large. Accordingly, when the heat developing photosensitive material 12 is fed from between the heater boxes 20 and 22, it is positioned on the rollers 34. By allowing each of the rollers 34 to be rotated and driven, the heat developing photosensitive material 12 is fed on the rollers 34.

Due to the above-described structure, the photosensitive layer of the heat developing photosensitive material 12 immediately after the heat-developing is not pressed and the image portion of the photosensitive layer does not contact rollers or the like. As a result, generation of wrinkles, abrasion, or the like can be prevented more reliably and an image of higher finished quality can be attained.

In the first embodiment of the present invention, although a set of heater boxes 20, 22 is disposed between the insertion roller pair 16 and the discharging roller pair 18, the structure of the heating means is not limited to the same.

Figure 5:
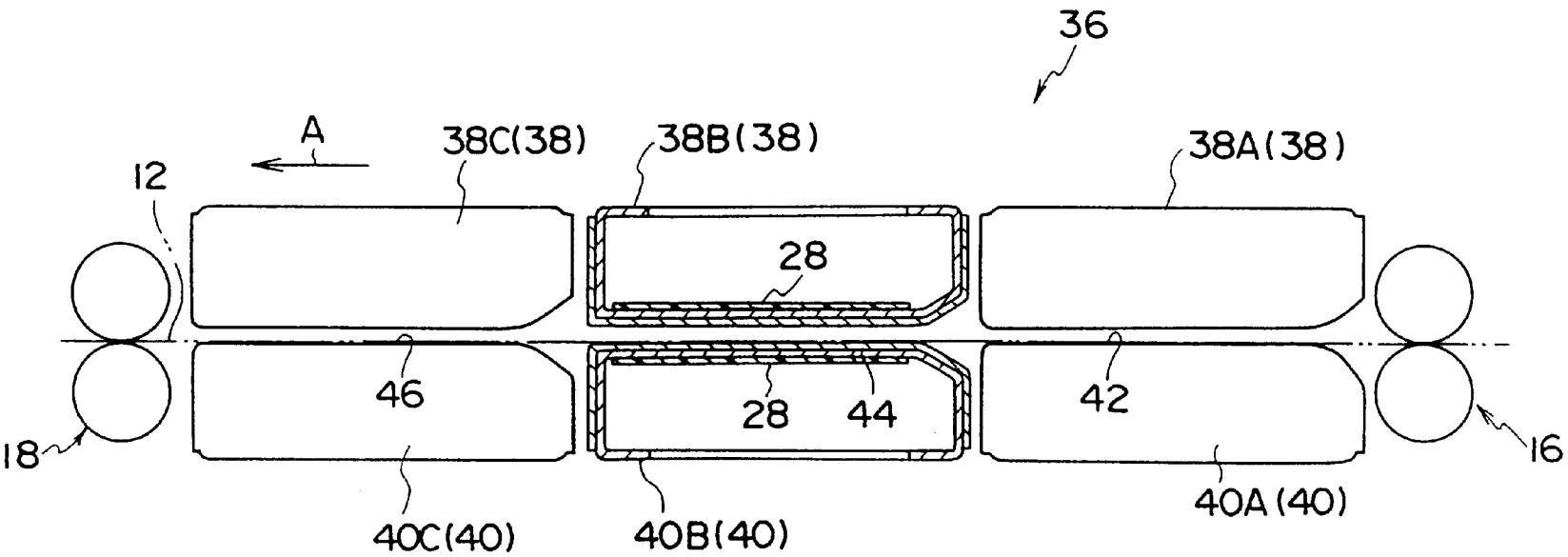
FIG. 5 is a schematic structural view of the heat developing section in which an arrangement of heater boxes which is different from that of the first embodiment of the present invention is provided.

For example, in a heat developing section 36 shown in FIG. 5, heater boxes 38A, 40A are provided at an upstream portion in the transporting direction of the heat developing photosensitive material 12, heater boxes 38B, 40B are provided at a midstream portion, and heater boxes 38C, 40C are provided at a downstream portion, (generically referred to as heater boxes 38, 40). Three sets of heater boxes 38, 40 are disposed with a predetermined spacing. Each of the heater boxes 38, 40 are tilted in a direction such that the upstream sides thereof in the transporting direction are apart from each other, so that the heat developing photosensitive material 12 is smoothly and reliably guided from between the upstream side heater boxes 38 and 40 to between the downstream side heater boxes 38 and 40.

In the heat developing section 36 structured as described above, the heating temperature of the heat developing photosensitive material 12 can be adjusted at each of the upstream portion, the midstream portion and the downstream portion along the direction the heat developing photosensitive material 12 is transported. Accordingly, it is possible to effect the precise adjustment of temperature according to the advance of the heat-developing of the heat developing photosensitive material 12.

At the heat developing section 36, a predetermined space is provided between the heater boxes 38 and 40 that are adjacent to each other along the direction the heat developing photosensitive material 12 is transported. For this reason, gas emitted from the heat developing photosensitive material 12 due to the progress of the heat-developing can be discharged from the transporting passage for the heat developing photosensitive material 12, thereby promoting the stable development of the heat developing photosensitive material 12.

In the heat developing section 36 structured as described above, the surface finish of the surface contacting the heat developing photosensitive material 12 may be changed at the heater boxes 40A, 40B and 40C. For example, at the upstream heater box 40A, the heat developing photosensitive material 12 is smoothly guided by adhering a non-woven fabric formed by a heat-resisting resin thereto, and further, a surface layer portion 42 is formed at the heater box 40A so that the heat developing photosensitive material 12 does not directly contact the heater box 40A. At the midstream heater box 40B, a surface layer portion 44, to which general surface treatment such as teflon coating, alumite processing or the like is applied, is formed. Moreover, at the downstream heater box 40C, a surface layer portion 46 is formed with an end of the surface thereof being oriented toward the downstream side in the direction in which the heat developing photosensitive material 12 is conveyed, so that the heat developing photosensitive material 12 can be smoothly guided without being damaged.

During the initial stage of the heat-developing in which the heat developing photosensitive material 12 is transported between the heater boxes 38A and 40A, extreme changes in the temperature of the heat developing photosensitive material 12 are prevented and generation of wrinkles or the like caused by extreme temperature changes is suppressed. During the middle stage of the heat-developing, in which the heat developing photosensitive material 12 is transported between the heater boxes 38B and 40B, the temperature of the heat developing photosensitive material 12 is stabilized. Thereafter, during the later stage of the heat-developing, in which the heat developing photosensitive material 12 is transported between the heater boxes 38C and 40C, the heat developing photosensitive material 12 is maintained at a predetermined temperature. Accordingly, it is possible to prevent irregularities in density due to irregularities in the temperature of the heat developing photosensitive material 12, to thereby accomplish an image of high quality.

Figure 6:
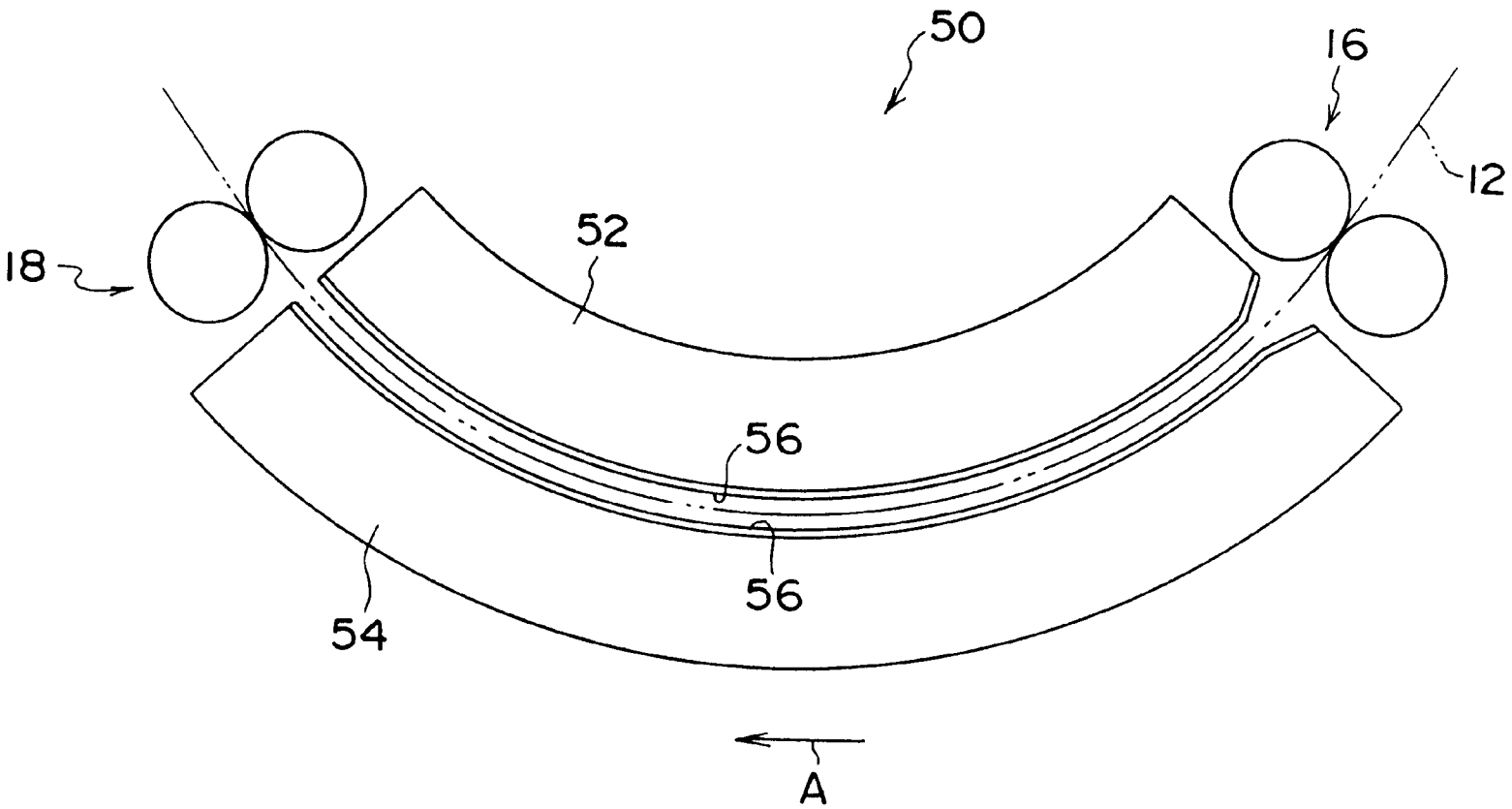
FIG. 6 is a schematic structural view illustrating one example of the heat developing section in which the shape of a transporting passage is different from that of the first embodiment of the present invention.

In the first embodiment of the present invention, although the transporting passage for the heat developing photosensitive material 12 is formed in a straight form, the shape of the transporting passage is not limited to the same. For example, at the heat developing section 50 as shown in FIG. 6, guides 52, 54, which are curved in a circular arc shape, respectively, are opposed to each other and disposed between the insertion roller pair 16 and the discharging roller pair 18 so as to form the transporting passage which protrudes downward (downward in FIG. 6). Each of the guides 52, 54 is heated to a predetermined temperature by an unillustrated heating means. The heat developing photosensitive material 12 is heat-developed by passing between the guides 52 and 54.

In the heat developing section 50 structured as described above, the heat developing photosensitive material 12, which is fed between the guides 52 and 54 by the insertion roller pair 16, is guided along the curved transporting passage while contacting the lower side guide 54.

The heat developing photosensitive material 12 is curved at the time of passing between the guides 52 and 54, and therefore, the heat developing photosensitive material 12 becomes firm with respect to a direction perpendicular to that in which the heat developing photosensitive material 12 is conveyed, and wrinkles become unlikely to form therein. Accordingly, in the heat developing section 50, generation of wrinkles or the like in the heat developing photosensitive material 12 during heat development can be prevented and there is no possibility of deterioration in the finished quality of the heat developing photosensitive material 12 caused by wrinkles or the like.

As heat-resisting non-woven fabrics 56 are provided at the transporting passage sides of the guides 52, 54, the heat developing photosensitive material 12, which is transported between the guides 52 and 54, is heated to a uniform temperature. Wrinkles, abrasion, or the like can be prevented from being generated at the photosensitive layer on which the image is formed, thereby forming an image of high quality without irregularities in density.

In the heat developing section 50, the heat developing photosensitive material 12 is curved with the photosensitive layer being oriented inside, but the heat developing photosensitive material 12 may be curved with the photosensitive layer being oriented outside. Further, the heat developing photosensitive material 12 may be curved along a direction perpendicular to the conveying direction.

At the heat developing section 14, the transporting passage for the heat developing photosensitive material 12 is provided so as to be substantially horizontal. However, so long as the surface of the heat developing photosensitive material 12 at a side opposite to the side at which the photosensitive layer is provided is disposed so as to contact the heater box 22, the transporting passage for the heat developing photosensitive material 12 may be tilted with respect to the horizontal direction.

Next, a description will be given of a second embodiment of the present invention. Note that the basic structure of the second embodiment is the same as that of the first embodiment, and therefore, the same components as those of the first embodiment will be denoted by the same reference numerals and a description thereof will be omitted.

Figure 7:
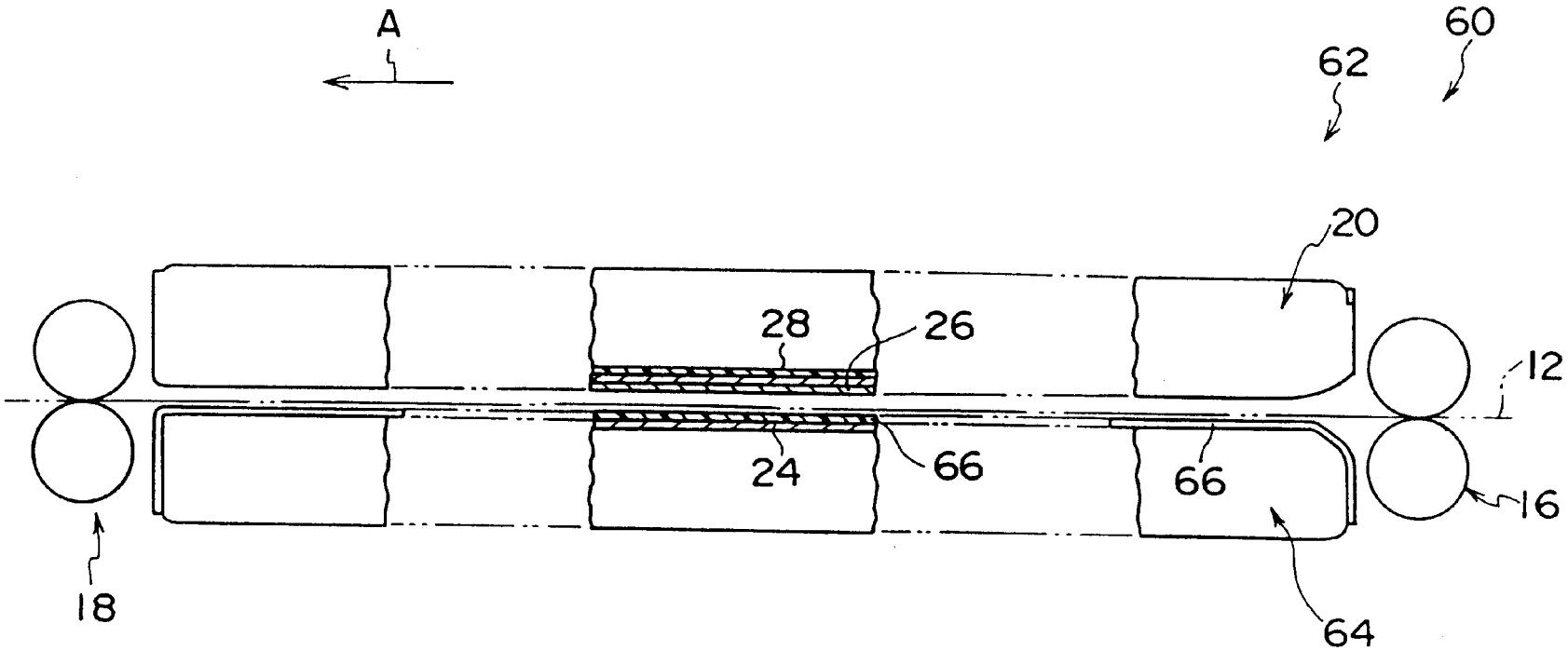
FIG. 7 is a schematic structural view illustrating a heat developing section of a heat developing apparatus, which is applied to a second embodiment of the present invention.

FIG. 7 shows a schematic structure of a heat developing apparatus 60 according to the second embodiment. In a heat developing section 62 of the heat developing apparatus 60, a heater box 64 is disposed so as to face the heater box 20. That is, the heater box 64 is used in place of the heater box 22 of the heat developing section 14. The heat developing photosensitive material 12 is transported by the insertion roller pair 16 between the heater boxes 20 and 64.

In the heater box 64, a surface layer portion of the guide plate 24 is formed by a heat insulating material 66. The heat insulating material 66 is provided so as to cover the guide plate 24. As a result, the heat developing photosensitive material 12 transported by the insertion roller pair 16 passes between the heater boxes 20 and 64 while a surface thereof, at a side opposite to the side at which the photosensitive layer is formed, contacts the heat insulating material 66.

A material whose thermal conductivity is low as compared to aluminum, from which the guide plate 24 is made, is used for the heat insulating material 66. For this reason, in the heat developing section 62, when the heat developing photosensitive material 12 contacts the heat insulating material 66, an amount of heat received from the heat insulating material 66 is small. Even if the heat developing photosensitive material 12 partially contacts the heat insulating material 66, no difference in the temperature is caused between a portion of the heat developing photosensitive material 12 that contacts the heat insulating material 66, and other portions thereof that do not contact the heat insulating material 66.

Accordingly, even if the heat developing photosensitive material 12 in a non-heated state is inserted by the insertion roller pair 16 between the heater boxes 20 and 64, there is no possibility of the surface temperature of the heat developing photosensitive material 12 changing due to heat received from the guide plate 24.

As the heat insulating material 66 described above, a member whose thermal conductivity is at least lower than that of the material for forming the guide plate 24 is used. Further, in order to prevent the heat developing photosensitive material 12 from being rapidly heated when the heat developing photosensitive material 12 contacts the heat insulating material 66, the thermal conductivity of the heat insulating material 66 is preferably 1Kcal/mh° C. or less.

As the heat insulating material described above, there are preferably used resin materials having a low thermal conductivity, such as fluorocarbon resin (thermal conductivity: 0.09 to 0.216 Kcal/mh° C.), polyphenylene sulfide (PPS) (thermal conductivity: 0.28 Kcal/mh° C.), polyimide (PI) (thermal conductivity: 0.36 Kcal/mh° C.), polyamide-imide (PAI) (thermal conductivity: 0.2 to 0.306 Kcal/mh° C.), polyacetal (POM) (thermal conductivity: 0.0576 to 0.216 Kcal/mh° C.), polyethersulphone (PES) (thermal conductivity: 0.1548 to 0.2052 Kcal/mh° C.), polycarbonate (PC) (thermal conductivity: 0.191 Kcal/mh° C.), acrylonitrile-butadiene-styrene (ABS) (thermal conductivity: 0.05 to 0.31 Kcal/mh° C.), and polyethylene terephthalate (PET) (thermal conductivity: 0.072 to 0.144 Kcal/mh° C.). In addition, resin materials such as aramid fiber, polyamide (PA), and polyethylene (PE), glass/glass fiber (thermal conductivity: 0.65 Kcal/mh° C.), and ceramic materials (thermal conductivity: 0.25 Kcal/mh° C.) can also be used.

As the heat insulating material 66, various members having a low thermal conductivity, such as the above-mentioned heat insulating materials can be used singly or in combination. Further, in the present embodiment, although the guide plate 24 is made from aluminum, the guide plate 24 may also be formed using resin materials or other metal materials such as stainless steel. The material used for the heat insulating material 66 need only be selected in accordance with the material used for the guide plate 24.

Further, the heat insulating material 66 may be formed at the guide plate 24 so as to coat the surface of the guide plate 24. Alternatively, the heat insulating material 66 may also be formed in such a manner that a non-woven fabric cloth made using the above-mentioned heat insulating material is mounted at the guide plate 24 at the side of the transporting passage, so as to cover the surface of the guide plate 24 facing the transporting passage. Moreover, the heat insulating material 66 may be formed into a bag to cover the guide plate 24 or the heater box 64.

In the heat developing apparatus 60 in which the heater box 64 is provided, when the heat developing photosensitive material 12 is fed to the heat developing section 62 by the insertion roller pair 16, the heat developing photosensitive material 12 contacts the heat insulating material 66 provided at the guide plate 24 of the lower heater box 64. Subsequently, the heat developing photosensitive material 12 is conveyed between the heater boxes 20 and 64 with an air layer being formed at the side of the photosensitive layer thereof.

When the heat developing photosensitive material 12 is fed between the heater boxes 20 and 64 by the insertion roller pair 16, the leading end portion thereof contacts the heat insulating material 66 of the heater box 64. The heat insulating material 66 is, together with the guide plate 24, heated to a predetermined temperature by the sheet-like heater 28, and when the heat developing photosensitive material 12 contacts the heat insulating material 66, the heat of the heat insulating material 66 is transmitted to the heat developing photosensitive material 12 due to thermal conductivity or the like.

At this time, the heat insulating material 66 has a low thermal conductivity and a low heat capacity, and therefore, there is no possibility of the temperature of the heat developing photosensitive material 12 sharply rising due to the heat transferred from the heat insulating material 66. Further, even if the heat developing photosensitive material 12 partially contacts the heat insulating material 66, no difference in the temperature is caused between a portion of the heat developing photosensitive material 12 that contacts the heat insulating material 66, and other portions thereof that do not contact the heat insulating material 66.

Accordingly, occurrence of uneven density caused by temperature changes in the heat developing photosensitive material 12 can be prevented, and further, generation of wrinkles or the like in the heat developing photosensitive material 12 due to variations in the amount of expansion of a base material caused by temperature changes can be prevented.

In the second embodiment, an entire region of the guide plate 24 along the direction in which the heat developing photosensitive material 12 is conveyed is covered by the heat insulating material 66. However, the heat insulating material 66 may also be formed so as to cover only a region of the guide plate 24 that contacts the heat developing photosensitive material 12, at least until the temperature of the heat developing photosensitive material 12 reaches a predetermined value.

Figure 8:
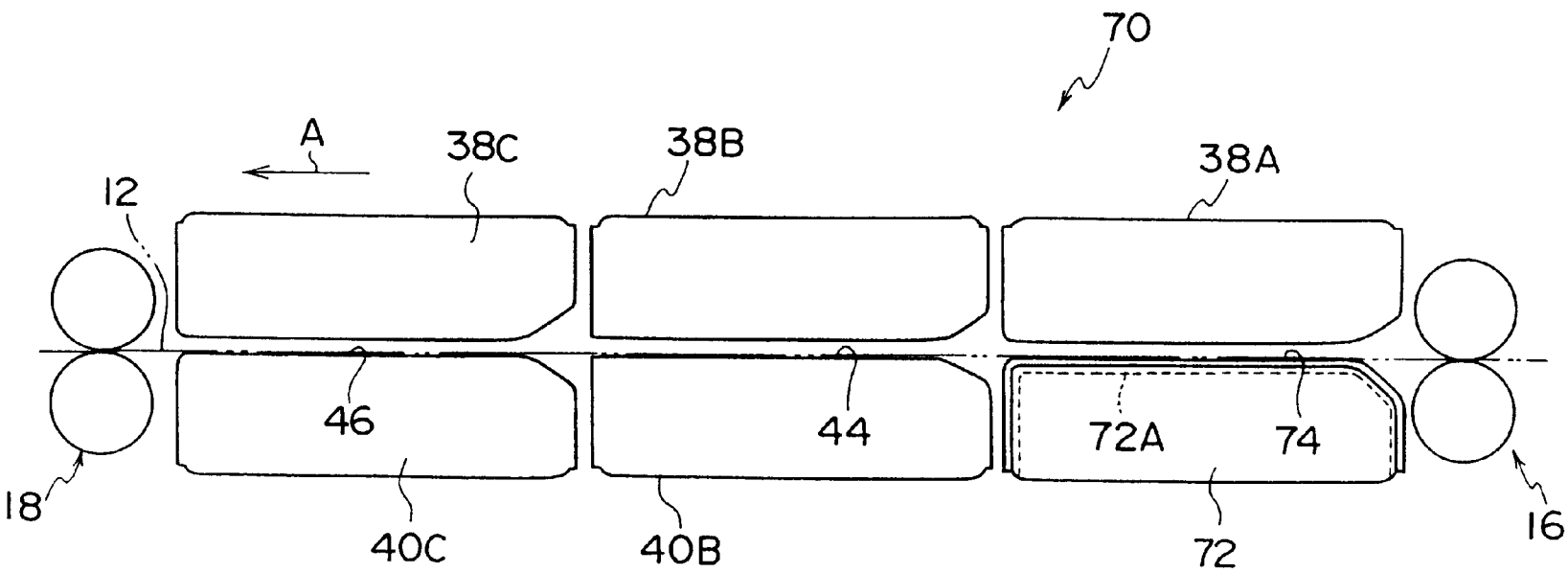
FIG. 8 is a schematic structural view of the heat developing section in which an arrangement of heater boxes which is different from that of the second embodiment of the present invention is provided.

For example, in a heat developing section 70 shown in FIG. 8, a heater box 72 is disposed at an uppermost stream side adjacent to the insertion roller pair 16 so as to face the heater box 38A. The heater box 72 is structured in such a manner that an upper surface of a guide plate 72A facing the transporting passage for the heat developing photosensitive material 12 is covered by a heat insulating material 74 formed by a member having a low thermal conductivity. In the heat developing section 70 shown in FIG. 8, the heater box 72 is disposed in place of the heater box 40A of the heat developing section 36 shown in FIG. 5.

As a result, it is possible to prevent occurrence of uneven density or wrinkles in the heat developing photosensitive material 12, which are caused by the heat transferred from the guide plate 72A contacting the heat developing photosensitive material 12, to the heat developing photosensitive material 12, at least during the initial heating stage.

The structure of the present invention is not limited to the first and second embodiments as described above. The present invention can be applied to a heat developing apparatus having any structure in which a heat developing photosensitive material is heat-developed between insertion means such as the insertion roller pair 16 and discharging means such as the discharging roller pair 18.

What is claimed is:

1. A heat developing apparatus in which a heat developing photosensitive material is heated while being transported, comprising:

a heating section for heating the heat developing photosensitive material;

insertion means which is disposed at an upstream side of said heating section and which nips and conveys the heat developing photosensitive material to the heating section;

discharging means which is disposed at a downstream side of the heating section and discharges the heat developing photosensitive material from the heating section;

heating means, in said heating section, for heating the heat developing photosensitive material as said photosensitive material is conveyed in the heating section; and guide means for guiding the heat developing photosensitive material, which is conveyed between said insertion means and said discharging means, while constantly forming an air layer on a first surface of the heat developing photosensitive material, which first surface has an image recorded thereon, wherein said guide means includes a guide plate which faces a transporting passage of the heat developing photosensitive material and a heat insulating member is provided on at least one portion of a surface of the guide plate, which guide-plate surface contacts the heat developing photosensitive material.

2. A heat developing apparatus in which a heat developing photosensitive material is heated while being transported, comprising:

a heating section for heating the heat developing photosensitive material;

insertion means which is disposed at an upstream side of said heating section and which nips and conveys the heat developing photosensitive material to the heating section;

discharging means which is disposed at a downstream side of the heating section and discharges the heat developing photosensitive material from the heating section;

heating means, in said heating section, for heating the heat developing photosensitive material as said photosensitive material is conveyed in the heating section; and guide means for guiding the heat developing photosensitive material, which is conveyed between said insertion means and said discharging means, while constantly forming an air layer on a first surface of the heat developing photosensitive material, which first surface has an image recorded thereon, wherein said discharging means discharges the heat developing photosensitive material in such a manner as not to contact an image region on said first surface of the heat developing photosensitive material;

wherein said insertion means is an insertion roller pair and said discharging means includes a discharging roller pair.

3. A heat developing apparatus according to claim 2, wherein said heat developing photosensitive material includes transported on a guide plate, which forms said guide means, with a photosensitive layer of the heat developing photosensitive material facing upward.

4. A heat developing apparatus according to claim 1, wherein said discharging means discharges the heat developing photosensitive material in such a manner as not to contact an image region on said first surface of the heat developing photosensitive material.

5. A heat developing apparatus according to claim 1, wherein said heat developing photosensitive material is transported on a guide plate, which forms said guide means, with a photosensitive layer of the heat developing photosensitive material facing upward.

6. A heat developing apparatus according to claim 1, wherein said insertion means is an insertion roller pair and said discharging means is a discharging roller pair.

7. A heat developing apparatus according to claim 2, wherein said heat developing photosensitive material is transported on a guide plate, which forms said guide means, with a photosensitive layer of the heat developing photosensitive material facing upward.

8. A heat developing apparatus according to claim 2, wherein a speed at which the heat developing photosensitive material is conveyed by said discharging roller pair is substantially the same as or a little higher than a speed at which the heat developing photosensitive material is conveyed by said insertion roller pair.

9. A heat developing apparatus according to claim 4, wherein said heat developing photosensitive material is transported on a guide plate, which forms said guide means, with a photosensitive layer of the heat developing photosensitive material facing upward.

10. A heat developing apparatus according to claim 6, wherein a speed at which the heat developing photosensitive material is conveyed by said discharging roller pair is substantially the same as or a little higher than a speed at which the heat developing photosensitive material is conveyed by said insertion roller pair.

11. A heat developing apparatus according to claim 1, wherein said heating means includes a plurality of heater boxes aligned on one side of said first surface of the heat developing photosensitive material, wherein said plurality of heater boxes are spaced from one another.

12. A heat developing apparatus according to claim 4, wherein said discharge means includes two roller pairs.

13. A heat developing apparatus according to claim 4, wherein said discharge means contacts a non-image region on said first surface of the heat developing photosensitive material.

14. A heat developing apparatus according to claim 2, wherein said heating means includes a plurality of heater boxes aligned on one side of said first surface of the heat developing photosensitive material, wherein said plurality of heater boxes are spaced from one another.

15. A heat developing apparatus according to claim 2, wherein said discharge means includes two roller pairs.

16. A heat developing apparatus according to claim 2, wherein said discharge means contacts a non-image region on said first surface of the heat developing photosensitive material.

17. A heat developing apparatus in which a heat developing photosensitive material is heated while being transported, comprising:

a heating section which heats the heat developing photosensitive material;

an insertion roller pair which is disposed at an upstream side of said heating section and which nips and conveys the heat developing photosensitive material to the heating section;

a plurality of discharging rollers disposed at a downstream side of the heating section which discharge the heat developing photosensitive material from the heating section;

a heater, in said heating section, which heating the heat developing photosensitive material as said photosensitive material is conveyed in the heating section; and a guide plate which guides the heat developing photosensitive material between said insertion roller pair and said plurality of discharging rollers, wherein said guide plate is arranged with respect to said heater so that an air layer is constantly formed between a first surface of the heat developing photosensitive material, which first surface has an image recorded thereon, and said heater, further wherein said guide plate has a heat insulating member provided on at least one portion of a surface of the guide plate, and said insulating member contacts the heat developing photosensitive material.

18. A heat developing apparatus in which a heat developing photosensitive material is heated while being transported, comprising:

a heating section which heats the heat developing photosensitive material;

an insertion roller pair disposed at an upstream side of said heating section and which nips and conveys the heat developing photosensitive material to the heating section;

a plurality of discharging rollers disposed at a downstream side of the heating section and which discharge the heat developing photosensitive material from the heating section;

a heater, in said heating section, which heats the heat developing photosensitive material as said photosensitive material is conveyed in the heating section; and a guide plate which guides the heat developing photosensitive material between said insertion roller pair and said plurality of discharging rollers, wherein said guide plate is arranged with respect to said heater so that an air layer is constantly formed between a first surface of the heat developing photosensitive material, which first surface has an image recorded thereon, and said heater, wherein said plurality of discharging rollers do not contact an image region on said first surface of the heat developing photosensitive material.

19. A heat developing apparatus according to claim 1, wherein said heat insulating member has a thermal conductivity of 1 Kcal/mh° C. or less.

20. A heat developing apparatus according to claim 17, wherein said heat insulating member has a thermal conductivity of 1 Kcal/mh° C. or less.

21. A heat developing apparatus according to claim 19, wherein said heat insulating member is at least one resin material selected from the group consisting of aramid fiber, fluorocarbon resin, polyphenylene sulfide, polyimide, polyamide-imide, polyacetal, polyethersulphone, polyamide, polycarbonate, acrylonitrile-butadiene-styrene, polyethylene and polyethylene terephthalate.

22. A heat developing apparatus according to claim 20, wherein said heat insulating member is at least one resin material selected from the group consisting of aramid fiber, fluorocarbon resin, polyphenylene sulfide, polyimide, polyamide-imide, polyacetal, polyethersulphone, polyamide, polycarbonate, acrylonitrile-butadiene-styrene, polyethylene and polyethylene terephthalate.

* * * * *